US011834967B1

(12) United States Patent
White, III

(10) Patent No.: US 11,834,967 B1
(45) Date of Patent: Dec. 5, 2023

(54) LINER FOR ANTI-ROTATION TAB AND CERAMIC COMPONENT

(71) Applicant: RAYTHEON TECHNOLOGIES CORPORATION, Farmington, CT (US)

(72) Inventor: Robert A. White, III, Meriden, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 17/743,544

(22) Filed: May 13, 2022

(51) Int. Cl.
*F01D 9/04* (2006.01)
*F01D 25/00* (2006.01)

(52) U.S. Cl.
CPC ..... *F01D 9/042* (2013.01); *F01D 25/005* (2013.01); *F05D 2220/32* (2013.01); *F05D 2240/12* (2013.01)

(58) Field of Classification Search
CPC ..... F01D 9/00; F01D 9/02; F01D 9/04; F01D 9/041; F01D 9/042; F01D 25/005; F01D 25/24; F01D 25/243; F01D 25/246; F01D 25/28; F05D 2260/30; F05D 2230/64; F05D 2240/12; F05D 2220/32
See application file for complete search history.

(56) References Cited

U.S. PATENT DOCUMENTS

| | | | | |
|---|---|---|---|---|
| 10,753,221 | B2 | 8/2020 | Barker et al. | |
| 11,220,930 | B2 | 1/2022 | Starr et al. | |
| 2019/0186271 | A1* | 6/2019 | Xu | F01D 5/142 |
| 2020/0072085 | A1* | 3/2020 | Sombounkhanh | F01D 9/041 |
| 2020/0158023 | A1* | 5/2020 | McCaffrey | F01D 25/246 |
| 2021/0054745 | A1* | 2/2021 | Vetters | F01D 5/147 |
| 2021/0071584 | A1 | 3/2021 | Barker et al. | |

FOREIGN PATENT DOCUMENTS

| | | |
|---|---|---|
| EP | 3351738 | 7/2018 |
| EP | 3587751 | 1/2020 |
| EP | 3653843 | 5/2020 |

OTHER PUBLICATIONS

European Search Report for European Patent Application No. 23173360.1 dated Oct. 12, 2023.

* cited by examiner

*Primary Examiner* — Elton K Wong
(74) *Attorney, Agent, or Firm* — Carlson, Gaskey & Olds, P.C.

(57) ABSTRACT

A gas turbine engine includes a first component, a second component, an anti-rotation tab, and a liner. The first component has a first wall that includes a first slot, and the second component has a second wall that includes a second slot that is in register with the first slot to define a groove. The anti-rotation tab extends into the groove and limits rotation of the first component and the second component. The liner lines the groove to limit wear between the anti-rotation tab and the first component and between the anti-rotation tab and the second component.

11 Claims, 5 Drawing Sheets

LINER FOR ANTI-ROTATION TAB AND CERAMIC COMPONENT

BACKGROUND

A gas turbine engine typically includes a fan section, a compressor section, a combustor section and a turbine section. Air entering the compressor section is compressed and delivered into the combustion section where it is mixed with fuel and ignited to generate a high-pressure and temperature exhaust gas flow. The high-pressure and temperature exhaust gas flow expands through the turbine section to drive the compressor and the fan section. The compressor section may include low and high pressure compressors, and the turbine section may also include low and high pressure turbines.

Airfoils and other components in the turbine section are often formed of a superalloy and may include thermal barrier coatings to extend temperature capability and lifetime. Ceramic materials are also being considered for turbine section components. Among other attractive properties, ceramics have high temperature resistance. Despite this attribute, however, there are unique challenges to implementing ceramic in turbine section components.

SUMMARY

A gas turbine engine according to an example of the present disclosure includes a first component that has a first wall that includes a first slot, and a second component that has a second wall that includes a second slot that is in register with the first slot. The first slot and the second slot together define a groove. An anti-rotation tab extends into the groove and limits rotation of the first component and the second component. A liner lines the groove to limit wear between the anti-rotation tab and the first component and between the anti-rotation tab and the second component.

In a further embodiment of any of the foregoing embodiments, the groove is defined by a groove floor and first and second sides. The liner includes a liner floor along the groove floor and first and second ears that extend off of the liner floor and along the first and second sides of the groove, respectively.

In a further embodiment of any of the foregoing embodiments, the liner floor includes a cantilevered spring tab.

In a further embodiment of any of the foregoing embodiments, the first ear has a first pair of clip arms, the second ear has a second pair of clip arms, the first pair of clips arms pinches onto the first wall and the second wall, and the second pair of clip arms pinches onto the first wall and the second wall.

In a further embodiment of any of the foregoing embodiments, the first and second ears are biased against the first and second sides of the groove, respectively.

In a further embodiment of any of the foregoing embodiments, the liner is metallic, the first wall is ceramic, and the second wall is ceramic.

In a further embodiment of any of the foregoing embodiments, relative to a gas turbine engine central axis, the first wall and the second wall are radially-oriented. The first wall and the second wall each has an axial face. The axial faces bear against each other. The first slot extends axially through the first wall, and the second slot extends axially though the second wall.

In a further embodiment of any of the foregoing embodiments, the groove is defined by a groove floor and first and second sides. The liner includes a liner floor along the groove floor and first and second ears that extend off of the liner floor and along the first and second sides of the groove, respectively, and the liner floor includes a cantilevered spring tab.

In a further embodiment of any of the foregoing embodiments, the first ear has a first pair of clip arms, the second ear has a second pair of clip arms, the first pair of clip arms and the second pair of clip arms open in opposite directions from each other, the first pair of clips arms pinches onto the first wall and the second wall, the second pair of clip arms pinches onto the first wall and the second wall.

In a further embodiment of any of the foregoing embodiments, the liner floor includes a pair of slots that flank the cantilevered spring tab, and at terminal ends of the pair of slots there are first and second bridges that connect the liner floor to the first and second ears.

A gas turbine engine according to an example of the present disclosure includes an airfoil fairing that has a ceramic wall that includes a first slot, and a support ring that has a wall that includes a second slot that is in register with the first slot. The first slot and the second slot together defines a groove. A case has an anti-rotation tab extending into the groove and limiting rotation of the airfoil fairing and the support ring. A liner lines the groove to limit wear between the anti-rotation tab and the airfoil fairing and between the anti-rotation tab and the support ring.

In a further embodiment of any of the foregoing embodiments, the liner is metallic, the first wall is ceramic, and the second wall is ceramic.

In a further embodiment of any of the foregoing embodiments, the groove is defined by a groove floor and first and second sides. The liner includes a liner floor along the groove floor and first and second ears that extend off of the liner floor and along the first and second sides of the groove, respectively, and the liner floor includes a cantilevered spring tab.

In a further embodiment of any of the foregoing embodiments, the first ear has a first pair of clip arms, the second ear has a second pair of clip arms, the first pair of clips arms pinches onto the first wall and the second wall, and the second pair of clip arms pinches onto the first wall and the second wall.

In a further embodiment of any of the foregoing embodiments, the first and second ears are biased against the first and second sides of the groove, respectively.

In a further embodiment of any of the foregoing embodiments, relative to a gas turbine engine central axis, the first wall and the second wall are radially-oriented. The first wall and the second wall each has an axial face. The axial faces bear against each other. The first slot extends axially through the first wall, and the second slot extends axially though the second wall.

A liner for a gas turbine engine according to an example of the present disclosure includes a liner floor that has a cantilevered spring tab, and first and second ears that extend off of the liner floor so as to define a receptacle there between.

In a further embodiment of any of the foregoing embodiments, the first ear has a first pair of clip arms and the second ear has a second pair of clip arms.

In a further embodiment of any of the foregoing embodiments, the first pair of clip arms and the second pair of clip arms open in opposite directions from each other.

In a further embodiment of any of the foregoing embodiments, the liner floor includes a pair of slots that flank the cantilevered spring tab, and at terminal ends of the pair of slots there are first and second bridges that connect the liner floor to the first and second ears.

The present disclosure may include any one or more of the individual features disclosed above and/or below alone or in any combination thereof.

BRIEF DESCRIPTION OF THE DRAWINGS

The various features and advantages of the present disclosure will become apparent to those skilled in the art from the following detailed description. The drawings that accompany the detailed description can be briefly described as follows.

In this disclosure, like reference numerals designate like elements where appropriate and reference numerals with the addition of one-hundred or multiples thereof designate modified elements that are understood to incorporate the same features and benefits of the corresponding elements.

DETAILED DESCRIPTION

Figure 1:
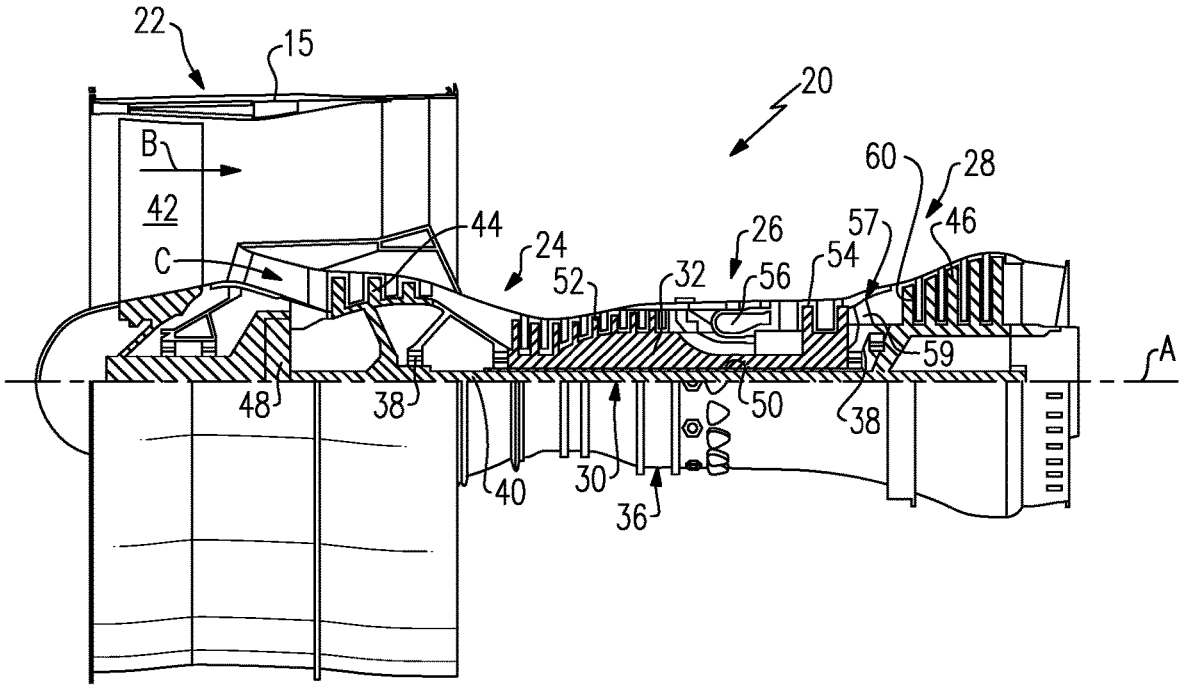
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in the exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), and can be less than or equal to about 18.0, or more narrowly can be less than or equal to 16.0. The geared architecture 48 is an epicyclic gear train, such as a planetary gear system or other gear system, with a gear reduction ratio of greater than about 2.3. The gear reduction ratio may be less than or equal to 4.0. The low pressure turbine 46 has a pressure ratio that is greater than about five. The low pressure turbine pressure ratio can be less than or equal to 13.0, or more narrowly less than or equal to 12.0. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to an inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. The engine parameters described above and those in this paragraph are measured at this condition unless otherwise specified. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45, or more narrowly greater than or equal to 1.25. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150.0 ft/second (350.5 meters/second), and can be greater than or equal to 1000.0 ft/second (304.8 meters/second).

Figure 2:
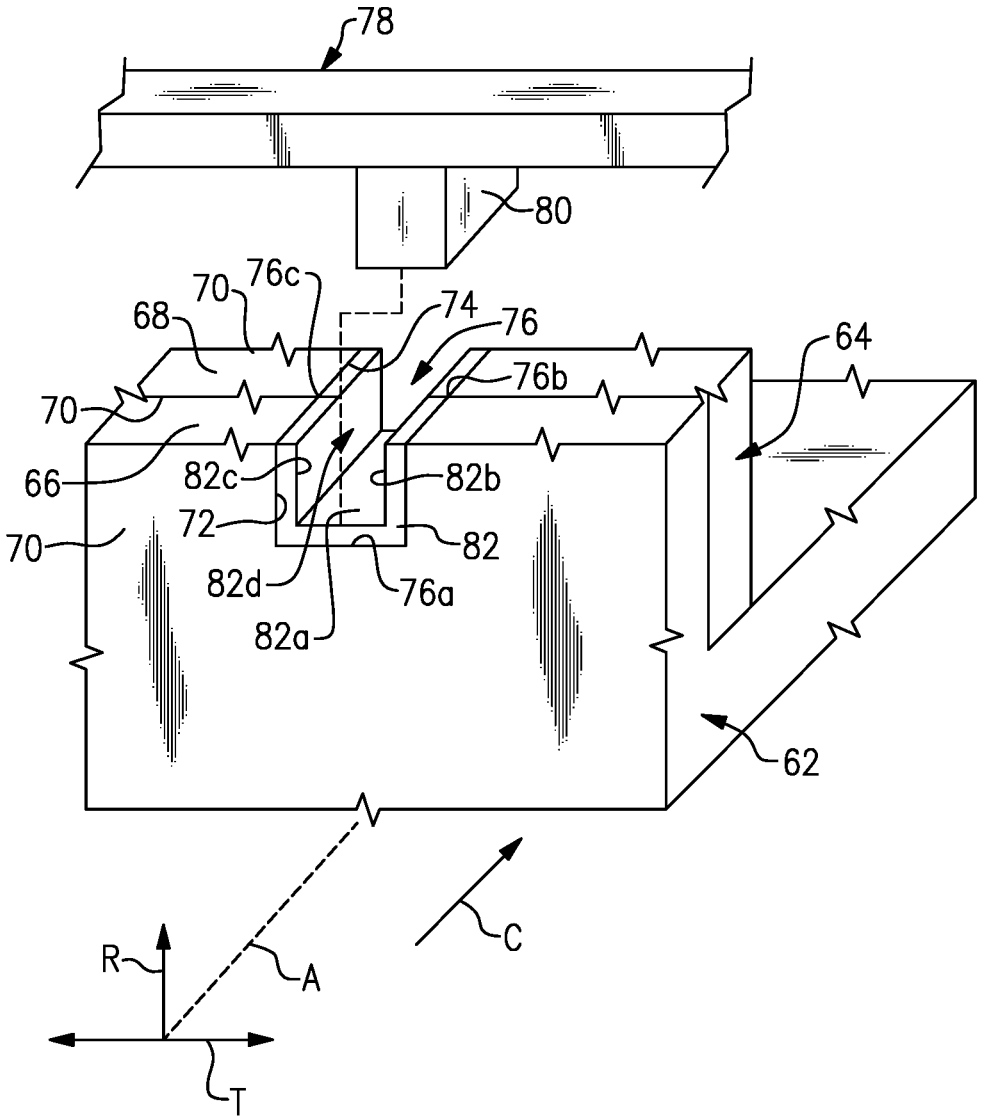
FIG. 2 illustrates a portion from the turbine section of the engine.

FIG. 2 illustrates a representative portion from the turbine section 28 of the engine 20. The engine central longitudinal axis A, radial direction R, and tangential (circumferential) direction T are superimposed in the figure to show the relative orientation of the features. As shown, there is a first component 62 and a second component 64. In this example, the first component 62 bounds a portion of the core gas path C of the engine 20, and the second component is outside of the core gas path C, radially outwards of the first component. Terms such as "inner" and "outer" used herein refer to location with respect to the engine central longitudinal axis A, i.e., radially inner or radially outer. Moreover, the terminology "first" and "second" used herein is to differentiate that there are two architecturally distinct components or features. It is to be further understood that the terms "first" and "second" are interchangeable in that a first component or feature could alternatively be termed as the second component or feature, and vice versa.

In this example, the first component 62 provides a radially outer bound of the core gas path C. It is to be understood, however, that the first component 62 may alternatively be at the radially inner bound of the core gas path C. For instance, the first component 62 may be a blade outer air seal, a platform of a vane fairing, a combustor liner, or other component in the core gas path C, and the second component 62 may be a support ring or other component outside of the core gas path C that mates with the first component 62.

The first component 62 has a first wall 66 and the second component 64 has a second wall 68. Each of the walls 66/68 is a radially-extending wall that has axially-facing faces 70. Here, the forward axially-facing face 70 of the second wall 68 bears against the aft axially-facing face 70 of the first wall 66.

The first wall 66 defines a first slot 72 that extends axially there through, and the second wall 68 defines a second slot 74 that extends axially there through. Each slot 72/74 has open ends at the respective axially-facing faces 70 of the walls 66/68, and an open top that faces radially. The second slot 74 is in register with the first slot 72 such that the slots 72/74 align along the tangential direction. In general, this means that the sides of the slots 72/74 are substantially flush. The slots 72/74 together define a groove 76. The bottoms of the slots 72/74 serve as a groove floor 76*a* and the tangential sides of the slots 72/74 serve as first and second sides 76*b*/76*c* of the groove 76.

There is also a third, static component 78, such as an engine case structure. The static component 78 includes an anti-rotation tab 8 that is of complementary geometry to the geometry of the groove 76. The tab extends radially into the groove 76 and serves to limit rotational movement of the first component 62 and the second component 64. The static component and anti-rotation tab 80 are formed of a metallic alloy, such as a Ni- or Co-based superalloy.

The first and second components 62/64 are each formed of ceramic. The ceramic of each of the first and second components 62/64 may be independently selected from a monolithic ceramic, a ceramic matrix composite ("CMC"), or configurations that include both monolithic ceramic and CMC. Example ceramic material may include, but is not limited to, silicon-containing ceramics. The silicon-containing ceramic may be, but is not limited to, silicon carbide (SiC) and/or silicon nitride ($Si_3N_4$). An example CMC may be a SiC/SiC CMC in which SiC fibers are disposed within a SiC matrix. As used herein, "formed of" refers to the structural self-supporting bodies of the components 62/64, rather than a non-self-supporting conformal body such as a coating.

CMC components in the core gas path C such as the first component 62 require axial, radial, and circumferential constraints to inhibit motion when loaded by gas path and/or secondary flow forces. However, metal-to-CMC interfaces between CMC components and metallic components such as the static component 78 may contribute to one or more conditions that can reduce durability. For example, the durability of metal-to-CMC interfaces can be sensitive to surface-on-surface rubbing, vibration, relative thermal expansion/contraction mismatches, temperatures in CMC components that exceed the limits of metallic alloys, undesired thermo-chemical reactions (e.g., between elements in Ni-based alloys and SiC), and load mal-distribution. To facilitate mitigation of one or more of these conditions in the disclosed arrangement, there is a liner 82 that lines the groove 76.

The liner 82 is attached in the groove 76 and is situated between the anti-rotation tab 80 and the sides 76*b*/76*c* of the groove 76 to limits contact and, therefore, wear. Although not limited, the liner may be formed of a Ni- or Co-based superalloy. Example alloys include Waspaloy, Inconel® by Huntington Alloys Corporation, Mar-M-509, Haynes alloy, and single crystal Ni-based superalloys. Co-based alloy may facilitate reductions in thermo-chemical reactions. The material may also be selected to optimize the wear couple between the liner 82 and the anti-rotation tab 80 and/or CMC surfaces of the components 62/64. The liner 82 includes a liner floor 82*a* along the groove floor 76*a* and first and second ears 82*b*/82*c* that extend off of opposite circumferential sides of the liner floor 82*a* and along the first and second sides 76*b*/76*c* of the groove 76, respectively. The liner floor 82*a* and ears 82*b*/82*c* define a receptacle 82*d* there between that receives the anti-rotation tab 80. The liner 82 may be secured in the groove 76 by friction fit but is not limited thereto and may additionally or alternatively utilize other mechanical attachments. The liner 82 may be installed into the groove 76 prior to insertion of the anti-rotation tab 80 into the receptacle 82*d*. In this regard, the liner 82 may initially serve to maintain the slots 72/74 of the components 62/64 in alignment prior to insertion of the anti-rotation tab 80.

Figure 3A:
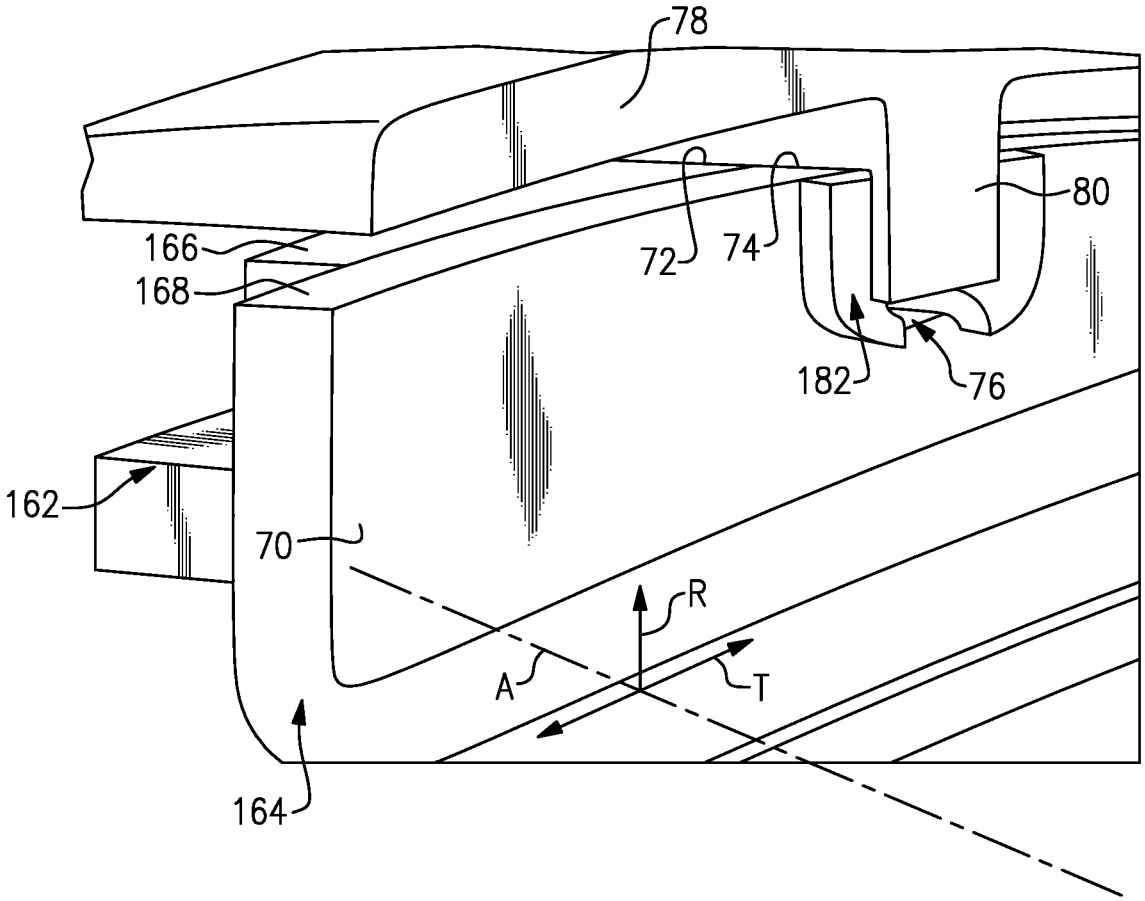
FIG. 3A illustrates a view of an anti-rotation tab and liner.
Figure 3B:
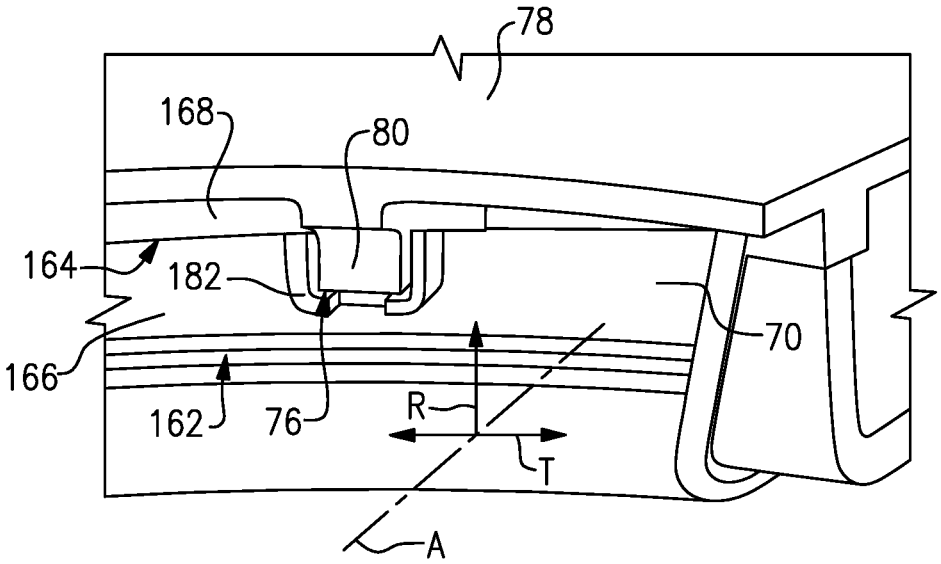
FIG. 3B illustrates another view of the anti-rotation tab and liner.
Figure 3C:
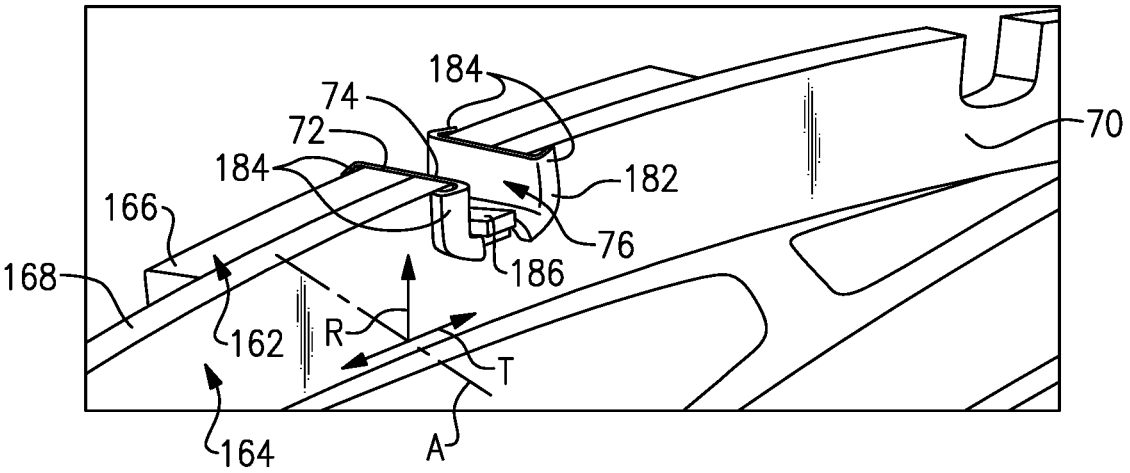
FIG. 3C illustrates another view of the liner but without the anti-rotation tab.
Figure 3D:
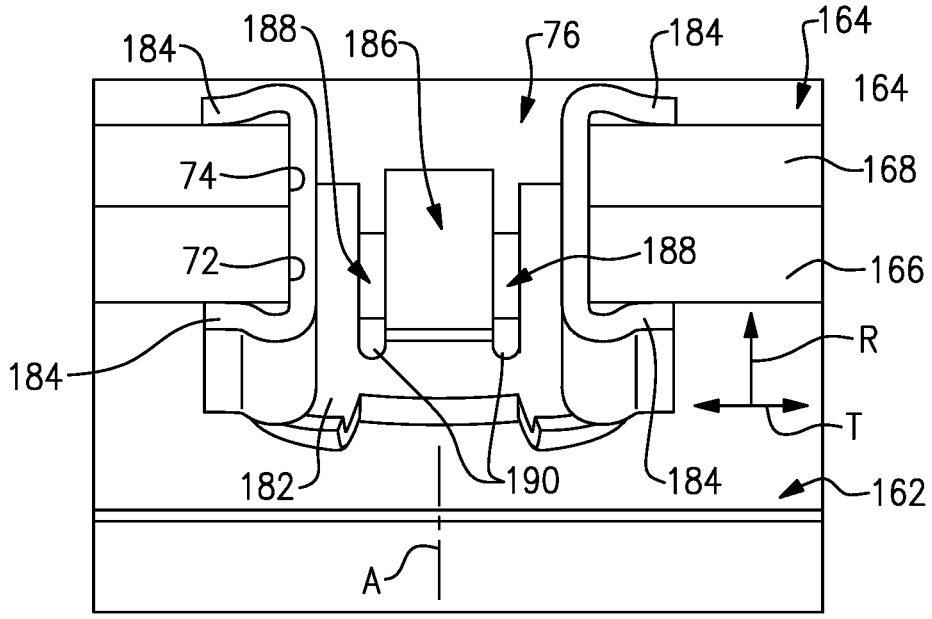
FIG. 3D illustrates a view of the immediate region of the liner.

FIGS. 3A, 3B, 3C, and 3D illustrate a further example of the present disclosure. FIG. 3A is a view looking toward the axially-aft face 70 of the second wall 168 of the second component 164; FIG. 3B is a view looking toward the axially forward face 70 of the first wall 166 of the first component 162; FIG. 3C is a view similar to FIG. 3A but without the static component 78; and FIG. 3D is a view of the immediate region of the groove 76 without the static component 78.

In this example, the first component 162 is a portion of a vane arc segment (e.g., a platform of an airfoil fairing) and the second component 164 is a full hoop support ring. The full hoop support ring is a continuous ring that has no intersegment gaps or seams (i.e., unsegmented) and few or no through-holes. For instance, the full hoop support ring may in a ring-strut-ring configuration in which a row of airfoil vane fairing arc segments are radially constrained between inner and outer full hoop support rings. The full hoop support ring may have a plurality of the slots 74 around its perimeter for alignment with an equal number of slots 72 of a plurality of first components 162 arranged in a circumferential row around the ring.

Figure 4:
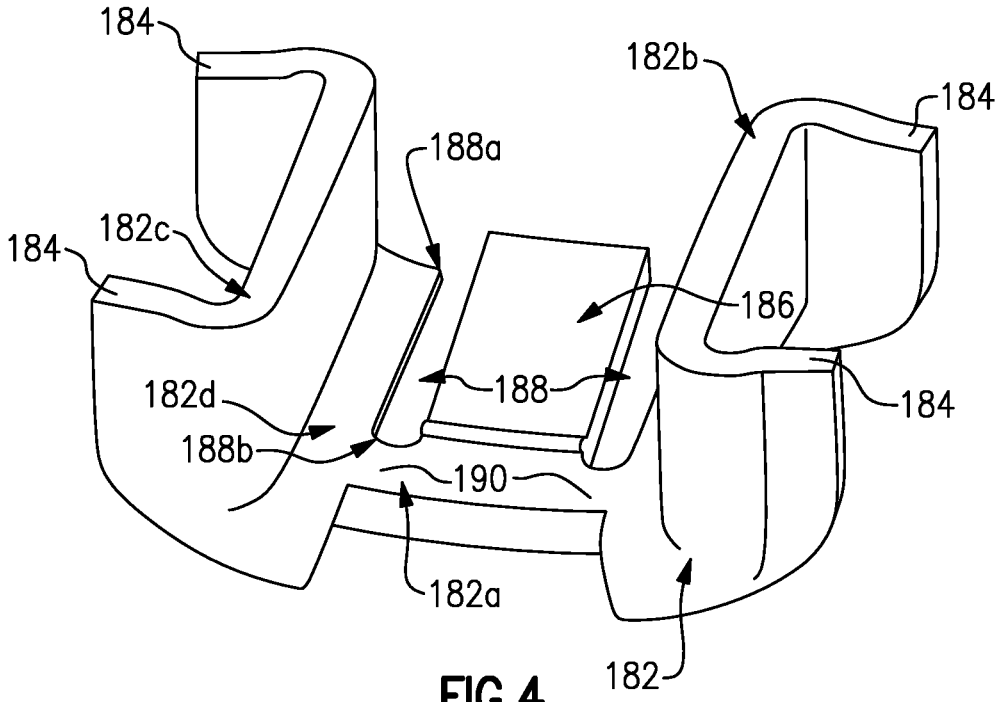
FIG. 4 illustrates an isolated view of the liner.

Like liner 82, the liner 182 lines the groove 76 and is situated between the anti-rotation tab 80 and the sides of the groove 76 to reduce wear there between. An isolated view of the liner 182 is shown in FIG. 4. The liner 182 has a liner floor 182*a* and first and second ears 182*b*/182*c* that extend off opposite circumferential sides of the liner floor 182*a* and define the receptacle 182*d* there between. In this example, each of the ears 182*b*/182*c* has a pair of axially spaced-apart clip arms 184. The pair of clip arms 184 on the ear 182*b* open in an opposite circumferential direction of the pair of clip arms 184 on the ear 182*c*.

The clip arms 184 include an elbow or bend at the base of the respective ear 182*b*/182*c* so as to render the arms 184 flexible. The spacing between the clips arms 184 is smaller than the combined thickness of the walls 166/168. The clip arms 184 pinch on the walls 166/168 on each side of the liner 182 (FIG. 3D). In this regard, the flexibility of the clip arms 184 permits that arms to spread apart to receive the walls 166/168. Once spread open, the arms are biased via the elbow to spring back to the initial, un-spread position. This bias serves to produce a pinching force and thus facilitates radial and circumferential retention of the liner 182 in the groove 76, reduction in vibration, and take up component tolerances. In a similar manner, the ears 182*b*/182*c* may also be spread apart from each other by a distance that is greater than the width of the groove 76 in the circumferential direction. Upon insertion of the liner 182 into the groove 76 the ears 182*b*/182*c* are compressed toward each other. Once compressed, the ears 182*b*/182*c* are biased to spring back to the initial, un-compressed position. This bias serves to further facilitate circumferential and radial retention of the liner 182 in the groove 76, reduce vibration, and take up component tolerances.

The liner floor 182*a* includes a cantilevered tab 186. The tab 186 is flanked (circumferentially) by two slots 188 that extend between the ears 182*b*/182*c* and the tab 186. The tab 186 slopes upwards from the remainder of the liner floor 182*a* so as to be raised from the lowest underside surface of the liner floor 182*a* (that contacts the groove floor 76*a*). The tab 186 is flexible in the radial direction. Upon insertion of the anti-rotation tab 80 into the receptacle 182*d* of the liner 182, the anti-rotation tab 80 bottoms out of the cantilevered tab 186, thereby deflecting the tab 186 radially. The spring force of the tab 186 serves to bias the liner 182 toward the groove floor 76*a*. This bias further serves to retain the liner 182 in the groove 76, reduce vibration, and also take up mismatches in thermal expansion/contraction between the metallic static component 78 and the ceramic components 162/164.

Each of the slots 188 has an open end 188*a* near the tip end of the tab 186 and a terminal end 188*b* near the base of the tab 186. At the terminal ends 188*b* there are respective bridges 190 that connect the liner floor 182*a* to the ears 182*b*/182*c*. Each bridge 190 is a relatively narrow band that serves as a spring flexion for the ears 182*b*/182*c* as discussed above. In this example, there is also a notch on the opposite side of the bridges 190 from the terminal ends 188*b* of the slots 188. The notch reduces weight of the liner 182, serves to narrow the bridges 190, and may facilitate manufacturing of the liner 182 by allowing facile bending of sheet metal to form the desired geometry of the liner 182. Although the liner 182 may be formed from sheet metal, it is not limited thereto and other manufacturing techniques are also applicable. The biases of the liner 182 may also serve to re-distribute stresses in the event that either of the components 162/164 tilts. Such a tilt may otherwise result in the concentration of stresses at a point or line of contact. However, the spring forces described above operate to re-distribute such stresses across the liner 182 and thus facilitate reduction in stress concentrations.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A gas turbine engine comprising:

a first component having a first wall including a first slot;

a second component having a second wall including a second slot that is in register with the first slot, the first slot and the second slot together defining a groove having a groove floor and first and second sides;

an anti-rotation tab extending into the groove and limiting rotation of the first component and the second component; and a liner lining the groove to limit wear between the anti-rotation tab and the first component and between the anti-rotation tab and the second component, the liner including a liner floor along the groove floor and first and second ears that extend off of the liner floor and along the first and second sides of the groove, respectively, the liner floor including a cantilevered spring tab and a pair of slots that flank the cantilevered spring tab, and at terminal ends of the pair of slots there are first and second bridges that connect the liner floor to the first and second ears.

2. The gas turbine engine as recited in claim 1, wherein the first and second ears are biased against the first and second sides of the groove, respectively.

3. The gas turbine engine as recited in claim 1, wherein the liner is metallic, the first wall is ceramic, and the second wall is ceramic.

4. The gas turbine engine as recited in claim 1, wherein, relative to a gas turbine engine central axis, the first wall and the second wall are radially-oriented, the first wall and the second wall each have an axial face, the axial faces bearing against each other, the first slot extends axially through the first wall, and the second slot extends axially through the second wall.

5. The gas turbine engine as recited in claim 1, wherein the first ear has a first pair of clip arms, the second ear has a second pair of clip arms, the first pair of clip arms and the second pair of clip arms open in opposite directions from each other, the first pair of clips arms pinches onto the first wall and the second wall, the second pair of clip arms pinches onto the first wall and the second wall.

6. A gas turbine engine comprising:

an airfoil fairing having a first, ceramic wall including a first slot;

a support ring having a second wall including a second slot that is in register with the first slot, the first slot and the second slot together defining a groove having a groove floor and first and second sides;

a case having an anti-rotation tab extending into the groove and limiting rotation of the airfoil fairing and the support ring; and a liner lining the groove to limit wear between the anti-rotation tab and the airfoil fairing and between the anti-rotation tab and the support ring, the liner including a liner floor along the groove floor and first and second ears that extend off of the liner floor and along the first and second sides of the groove, respectively, the liner floor including a cantilevered spring tab and a pair of slots that flank the cantilevered spring tab, and at terminal ends of the pair of slots there are first and second bridges that connect the liner floor to the first and second ears.

7. The gas turbine engine as recited in claim 6, wherein the liner is metallic, and the second wall is ceramic.

8. The gas turbine engine as recited in claim 6, wherein the first ear has a first pair of clip arms, the second ear has a second pair of clip arms, the first pair of clips arms pinches onto the first wall and the second wall, and the second pair of clip arms pinches onto the first wall and the second wall.

9. The gas turbine engine as recited in claim 8, wherein the first and second ears are biased against the first and second sides of the groove, respectively.

10. The gas turbine engine as recited in claim 9, wherein, relative to a gas turbine engine central axis, the first wall and the second wall are radially-oriented, the first wall and the second wall each have an axial face, the axial faces bearing against each other, the first slot extends axially through the first wall, and the second slot extends axially through the second wall.

11. A liner for a gas turbine engine, the liner comprising:

a liner floor having a cantilevered spring tab; and first and second ears that extend off of the liner floor so as to define a receptacle there between, wherein the liner floor includes a pair of slots that flank the cantilevered spring tab, and at terminal ends of the pair of slots there are first and second bridges that connect the liner floor to the first and second ears, the first ear having a first pair of clip arms and the second ear having a second pair of clip arms, the first pair of clip arms and the second pair of clip arms opening in opposite directions from each other.

* * * * *